US005118357A

United States Patent [19]

Sabatka

[11] Patent Number: 5,118,357

[45] Date of Patent: Jun. 2, 1992

[54] TREATMENT FLUID APPLICATION AND RECOVERY APPARATUS AND METHOD

[75] Inventor: Winston E. Sabatka, Lakeville, Minn.

[73] Assignee: Finishing Equipment, Inc., St. Paul, Minn.

[21] Appl. No.: 672,372

[22] Filed: Mar. 20, 1991

[51] Int. Cl.[5] ..... B08B 3/02

[52] U.S. Cl. ..... 134/15; 134/64 R; 134/122 R; 134/108; 134/102

[58] Field of Search ..... 134/64 R, 64 D, 122 R, 134/122 P, 105, 200, 108, 102, 10, 15, 40; 68/5 E

[56] References Cited

U.S. PATENT DOCUMENTS

| | | | |
|---|---|---|---|
| 1,739,947 | 12/1929 | Chapin et al. | 68/5 E |
| 3,350,734 | 11/1967 | Holm | 134/122 R X |
| 3,351,348 | 11/1967 | Dupis | 68/5 E X |
| 3,491,779 | 1/1970 | Mclain et al. | 134/108 |
| 3,613,699 | 10/1971 | Holm | 134/105 |
| 3,896,829 | 7/1975 | Sabatka | 134/58 R |
| 3,929,409 | 12/1975 | Buchner | 134/64 R X |
| 4,204,913 | 5/1980 | Sabatka | 202/168 |
| 4,289,586 | 9/1981 | Sabatka | 203/1 |
| 4,576,792 | 3/1986 | Martensson | 134/102 X |
| 4,788,992 | 7/1988 | Swainbank et al. | 134/108 X |
| 4,838,476 | 6/1989 | Rahn | 134/108 X |

*Primary Examiner*—Frankie L. Stinson

*Attorney, Agent, or Firm*—Kinney & Lange

[57] ABSTRACT

A treatment cell for spraying two phase treatment fluid on a continuously moving strip work product is enclosed within an air impervious containment chamber having ingress and egress openings to receive and discharge the work proudct. Air knives in the containment chamber receive air under pressure from a blower and this air strips any residual treatment fluid from work product at the chamber entry and egress openings. The air blower is within the chamber and the only air used through the air knives is continuously recycled entirely within the chamber. Cooling coils low in the chamber condense some of the vapor phase treatment fluid from the air in the container and all of the liquid phase of the treatment fluid flows by gravity to a sealed sump for reuse in the treatment cell.

11 Claims, 3 Drawing Sheets

TREATMENT FLUID APPLICATION AND RECOVERY APPARATUS AND METHOD

BACKGROUND OF THE INVENTION

The present invention relates to a treatment fluid recovery apparatus, and in particular, it relates to a treatment fluid recovery apparatus for treating an elongate, continuously moving work product.

In standard operations today, huge amounts of treatment fluids which have a liquid phase and a heavier-than-air vapor phase within the operating range of temperatures are being emitted to the atmosphere in treatment operations involving elongate work products such as strip sheets, tubing and wire. These include, for example, III-trichlorethane, perchlor and trichlorethylene. Typically, the treatment operations involve spraying or flooding the work products in a treatment cell or other enclosure and above a container. The treatment cell itself and the container are ventilated in an attempt to maintain safe operating conditions in the area of this treatment operation. This ventilation process removes air and treatment fluid vapors directly from the spray area and treatment area. Typically, there is little or no attempt to recover these vapors in this air stream because the recovery process, such as carbon absorption and refrigeration, involves high maintenance and energy costs and could cause corrosion which results in unreliability of the system. The result of use of this type of system is that hundreds of thousands of pounds per year of treatment fluid vapors can be discharged and lost from a relatively small operation with great damage to the environment and at great cost to the user.

Patents which describe treatment fluid recovery apparatuses are Sabatka U.S. Pat. No. 3,896,829 issued Jul. 29, 1975, Sabatka U.S. Pat. No. 4,204,913 issued May 27, 1980, and Sabatka U.S. Pat. No. 4,289,586 issued Sep. 15, 1981. The Sabatka '829 patent describes an open top treatment tank used for chemically treating work pieces with a treatment fluid. A stage is provided to lower the work pieces to be treated into the tank where vapor condenses on the work pieces. A treatment tank lid closes the open tank top after the stage has brought the work into the tank. An agitated spray of fluid is directed against the work piece while the lid is in place. When the processing has been completed on the work piece, the stage and work piece are hoisted from the tank to allow liquid on the stage and work piece to drain back into the tank. A second lid closes the stage entrance.

The Sabatka '913 and '586 patents describe a solvent recovery apparatus and method having a treatment tank for chemically treating work pieces in a treatment fluid. The dirty or contaminated treatment fluid is reclaimed by confining it in a closed boiling vessel and boiling it off through a conduit back into vapor phase of the fresh fluid in an active operating treatment tank.

SUMMARY OF THE INVENTION

This invention provides an apparatus for substantially reducing the amount of discharge into the atmosphere of airborne treatment fluids which can change between a liquid phase and a vapor phase.

In a broad aspect of the invention, an apparatus is provided for applying a treatment fluid to an elongate, continuously moving work product as it passes through a treatment area within a fluid impervious containment chamber having an ingress aperture and an egress aperture for encompassing the "continuous" work product as it enters and leaves the chamber, respectively.

The improvement includes providing an air flow restriction seal over at least the egress aperture to the containment chamber and providing a blower means operating entirely within the chamber to blow only the air in the chamber and any air entrained vapor in the chamber toward the moving work product at least between the egress aperture and the treatment area in direction away from the egress aperture and toward the treatment area.

In the form of the invention as shown, an air flow restriction seal is also provided over the ingress aperture of the containment chamber and the blower means blows the air and entrained vapor within the chamber toward the work product between the ingress aperture and the treatment area in direction away from the ingress aperture and toward the treatment area.

Also as in the form of the invention as shown, it is usual to constitute the treatment area as a self-contained treatment cell. The remainder of this specification deals with this more specific form of the invention.

In that form of the invention, an apparatus is provided for applying such a treatment fluid from a sealed reservoir to an elongate, continuously moving work product as it passes through a treatment cell.

The treatment cell is completely encompassed by a walled containment chamber which is impervious to the passage of fluid but which has an ingress aperture and an egress aperture open through those walls. The treatment fluid is delivered from the sealed reservoir through a sealed conduit open to the interior of the treatment cell in the interior of the chamber. The containment chamber ingress aperture is adapted to be in surrounding relation to the moving work product as it moves into the chamber in direction toward and through the treatment cell; and its egress aperture is adapted to surround the moving work product as it moves out of the containment chamber.

Air flow restriction seals are provided over the ingress aperture and the egress aperture. Each seal is provided with an opening of configuration to come into intimate, fluid-retarding relation to the moving work product as it moves through its adjacent aperture.

A blower means entirely within the containment chamber directs air within the chamber and any air entrained vapor within the chamber toward the moving work product between the egress aperture and the treatment cell in direction away from the egress aperture and toward the treatment cell with sufficient force to tend to strip any liquid phase of the treatment fluid from the moving work product.

The blower means also directs air within the chamber and any air entrained vapor present within the chamber toward the moving work product between the ingress aperture and the treatment cell in direction away from the ingress aperture.

A cooling means within the chamber operates at a cooling temperature to lower the vapor pressure of the fluid and condense to some of the treatment fluid from the air. Sealed recovery means is provided to convey the liquid phase of the treatment fluid from bottom portions of the containment chamber and of the treatment cell back into the sealed reservoir.

DETAILED DESCRIPTION OF THE PREFERRED EMBODIMENTS

Figure 1:
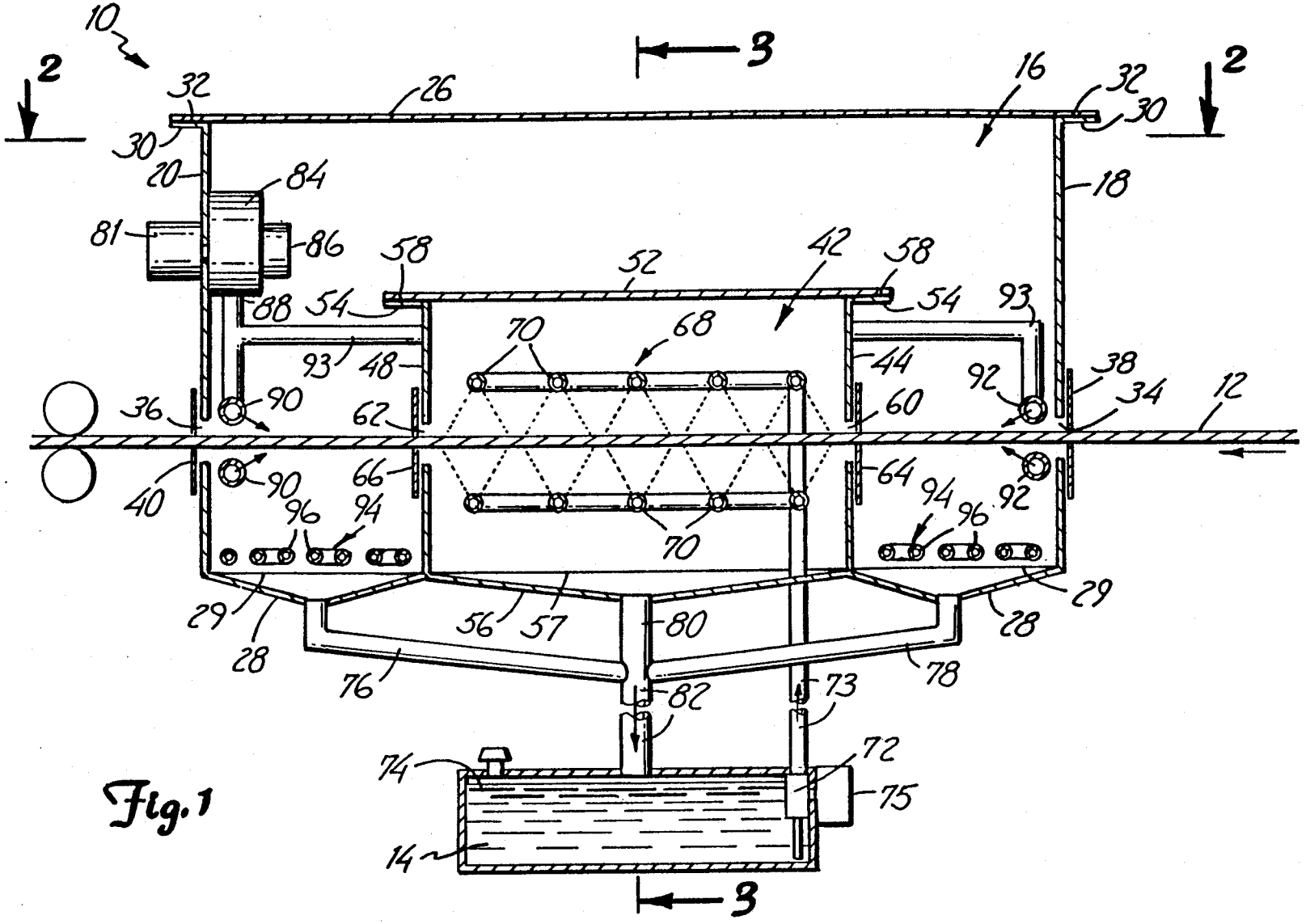
FIG. 1 is a partially schematic sectional side view of a treatment fluid application and recovery apparatus of the present invention.
Figure 2:
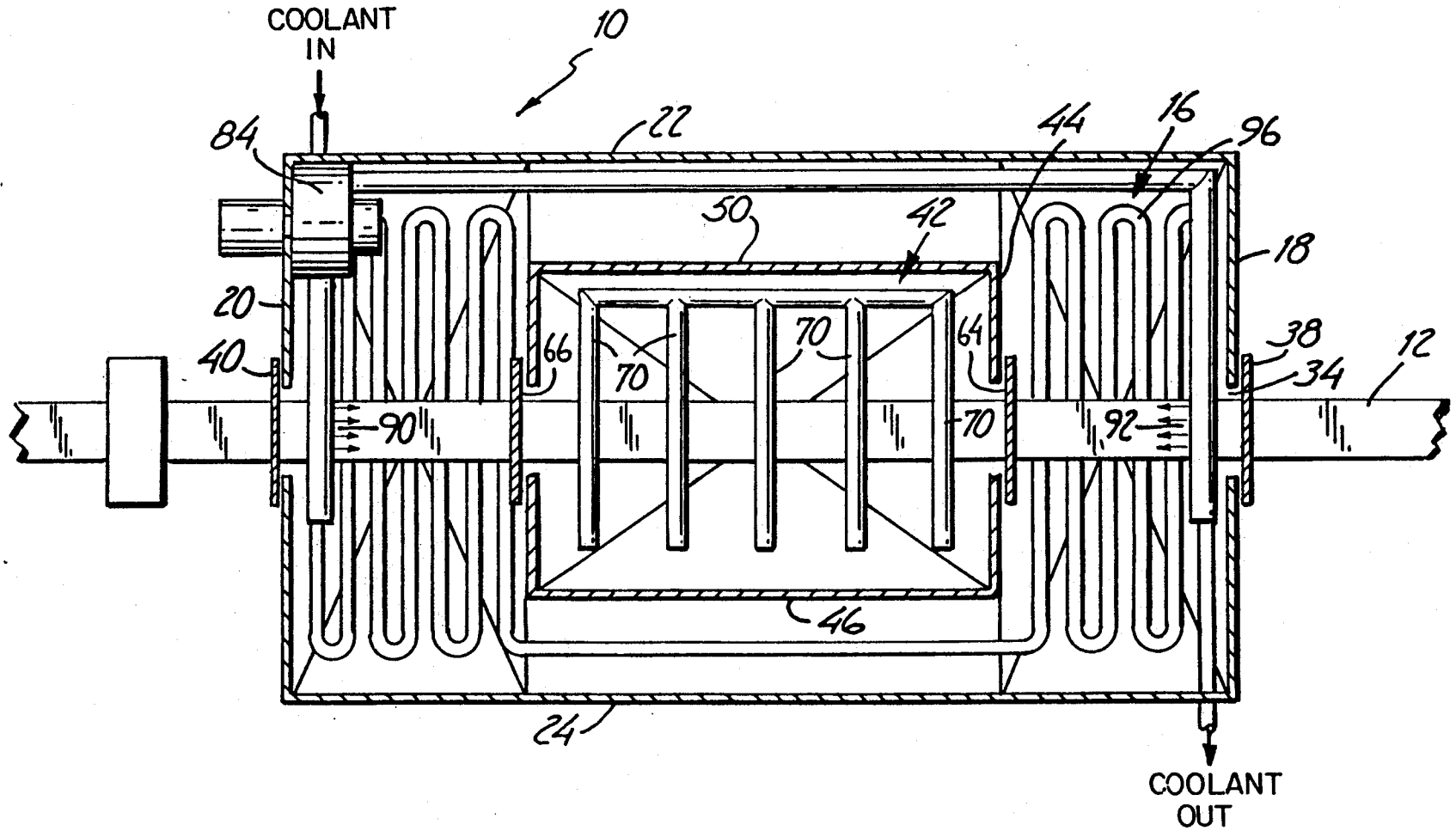
FIG. 2 is a horizontal sectional top view taken along line 2—2 in FIG. 1.
Figure 3:
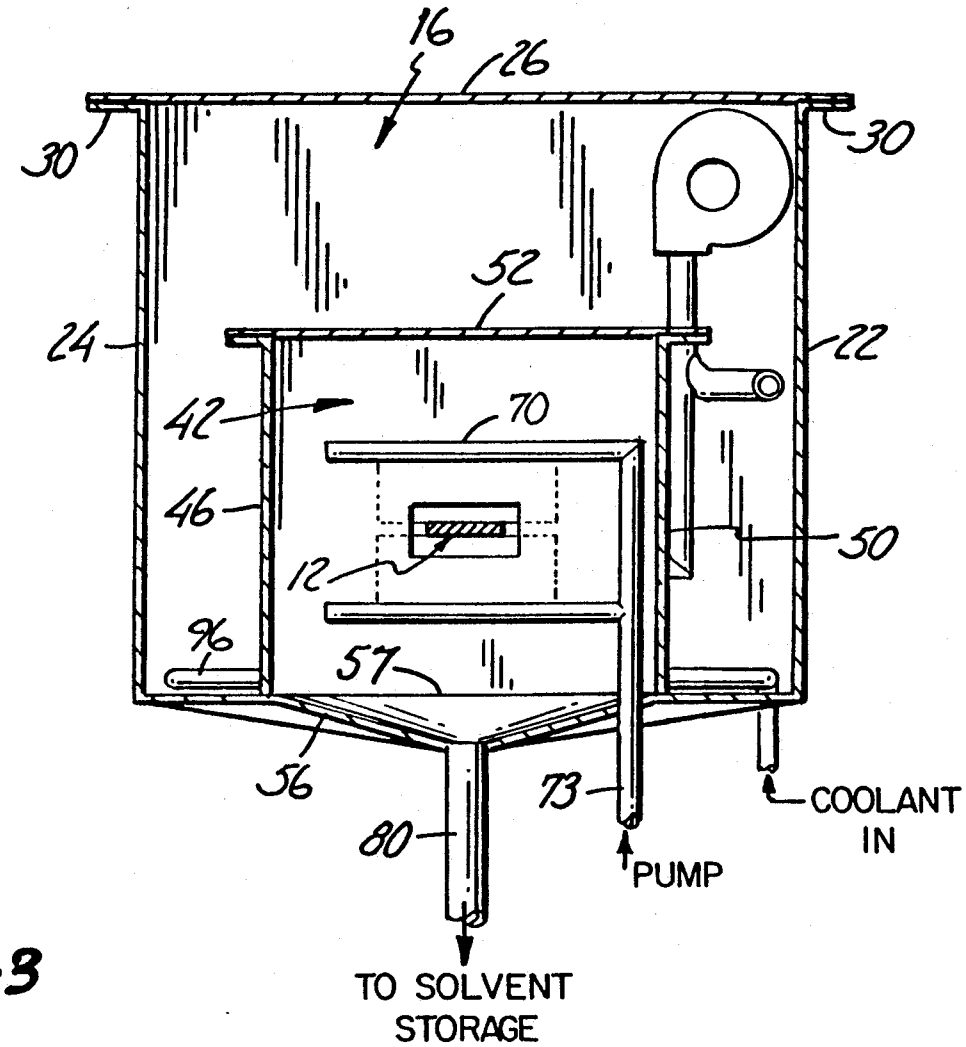
FIG. 3 is a vertical sectional view taken along line 3—3 in FIG. 1.

A treatment fluid application and recovery apparatus 10 is for use in treating an elongate and continuously moving work product 12 with a treatment fluid 14 having a liquid phase and a heavier-than-air vapor phase. The work product 12 can include strip sheets, rods, tubes, wire, and other elongated work products having a length which prevents the work product 12 from being treated during a single treatment step as described in Sabatka '829, for example.

The typical types of treatment fluids 14 are solvents or other fluids including, but not limited to, III-trichlorethane, perchlor or trichlorethylene. It is to be understood. however, that the invention can be successfully used with many solvents or other fluids which have, within the operating temperature ranges, a liquid phase and heavier-than-air vapor phase.

The apparatus 10 includes a hollow containment chamber 16 having a plurality of side walls 18, 20, 22 and 24, a containment cover 26 and a funnel-shape funnel-shape base wall 28. The side walls 18 and 22 are mutually parallel as are the side walls of 20 and 24. The side walls 18 and 22 are substantially perpendicular to the side walls 20 and 24; and all four of them are connected to, and are substantially perpendicular to, an upper edge 29 of the base wall 28. The side walls 18, 20, 22 and 24 form a containment chamber rim 30 around the containment chamber 16.

The containment cover 26 overlies the containment chamber rim 30 of the side walls 18, 20, 22 and 24. The containment cover 26 is releasably affixed to the containment chamber rim 30 such that the containment cover 26 can be removed when necessary to service the apparatus 10. An appropriate fluid-tight containment cover seal 32 of any usual or preferred construction is provided between the containment chamber rim 30 and the containment cover 26.

The side wall 18 is provided with a first containment chamber work product ingress aperture 34 and the side wall 22 is provided with a second containment chamber work product egress aperture 36. The containment chamber apertures 34 and 36 are sufficiently sized and properly aligned to allow the work product 12 to pass therethrough.

Flexible containment chamber aperture air flow restriction seals 38 and 40 are positioned against the edges of the first and second containment chamber apertures 34 and 36, respectively, and are provided with openings therethrough which fit snugly against the moving work product 12. These seals tend to reduce or minimize loss of free liquid phase of treatment fluid 14 and of air laden with treatment fluid in its vapor phase from leaving the containment chamber 16. These seals 38 and 40 can be of any usual or preferred material and construction forming no part of the invention per se. Containment aperture seals 38 and 40 are shown spaced from the walls 18 and 20 to improve the clarity of illustration. They are, in actual usage, sealed to completely cover apertures 34 and 36.

Typical materials used in such containment aperture seals 38 and 40 include, but are not limited to, elastomer, viton or teflon.

In the form of the invention as shown, a hollow treatment cell 42 is located entirely within the containment chamber 16. The treatment cell 42 has a plurality of side walls 44, 46, 48 and 50 and a treatment cell cover 52. The side walls 44 and 48 are mutually parallel as are the side walls 46 and 50. The side walls 44 and 48 are substantially perpendicular to the side walls 46 and 50; and all four of them are substantially perpendicular to the plane of the upper edge 29 of the base wall 28 and to the plane of an upper edge 57 of a funnel-shape treatment cell base wall 56. The side walls 44, 46, 48 and 50 define a treatment cell rim 54 around the top of the treatment cell 42. The treatment cell base wall upper edge 57 of the treatment cell base wall 56 is substantially coplanar to the upper edge 29 of the base wall 28; and the treatment cell base wall 56 is integral to the containment chamber base wall 28.

The treatment cell cover 52 overlies the treatment cell rim 54 of the side walls 44, 46, 48 and 50. The treatment cell cover 52 is releasably affixed to the treatment cell rim 54 such that the treatment cell cover 52 can be removed when necessary to service the apparatus 10. An appropriate fluid-tight treatment cell cover seal 58 of any usual or preferred construction is provided between the treatment cell rim 54 and the treatment cell cover 52.

The side wall 44 is provided with a first treatment cell work product ingress aperture 60 and the side wall 48 is provided with a second treatment cell egress aperture 62. The apertures 60 and 62 are sufficiently sized and aligned to allow the work product 12 to pass therethrough.

First and second flexible treatment cell aperture seals 64 and 66, similar to the flexible containment chamber aperture seals 38 and 40, are positioned against the edges of the first and second treatment cell apertures 60 and 62, respectively, and are provided with openings therethrough which fit snugly against the moving work product 12. These seals tend to reduce or minimize loss of free liquid phase of fluid 14 and of air laden with such fluid in its vapor phase from leaving the treatment cell 42. These seals 64 and 66 can be of any usual or preferred material and construction and form no part of the invention per se. These seals 64 and 66 are also shown spaced from the walls 44 and 48, respectively, to improve the clarity of the illustration.

The same type of materials used in containment chamber aperture seals 38 and 40 will be effective in treatment cell aperture seals 64 and 66.

Within the treatment cell 42 is an application means or mechanism 68 for applying the treatment fluid 14 to the work product 12. The application mechanism 68 includes a plurality of spraying mechanisms 70, although any appropriate type of application mechanism is within the scope of the present invention. The spraying mechanisms 70 are connected to a pump 72 by a supply pipe 73 and direct the fluid 14 against the moving work product 12. The liquid phase of this treatment fluid 14 then drains out from the funnel-shape base walls 28 and 56 to a treatment fluid storage sump or reservoir 74 via a plurality of drain pipes 76, 78 and 80 and a main drain pipe 82. Both the pump 72 and the reservoir 74 are external to the treatment cell 42 and the containment chamber 16, as are drain pipes 76, 78, 80 and 82. All of these external components are sealed tight, preventing any possibility of escape of either phase of the fluid 14 therethrough.

As shown, the pump 72 is located within the reservoir 74 and has a pump motor 75 external to the reservoir 74. A fluid-tight rotary seal between the pump 72 and the pump motor 75 of any usual or preferred construction is provided and forms no part of the invention per se.

The reservoir 74 provides the treatment fluid 14 to the pump 72, and receives returned treatment fluid 14 from the treatment cell 42 and the recovered treatment fluid 14 from the containment chamber 16. Additional treatment fluid 14 will be added to the reservoir 74 by the operator as needed, but the amount of make-up treatment fluid 14 required will be drastically reduced over that needed in prior art operations.

The pump 72 pumps the treatment fluid 14 from the reservoir 74 to the spraying mechanisms 70 via the supply pipe 73. The spraying mechanisms 70 direct the treatment fluid 14 to all sides of the work product 12. In this process, it is to be expected that a substantial amount of treatment fluid 14 will pass from liquid to an air entrained vapor phase if the volume of air in cell 42 was not so limited by the size of that cell. In point of fact, the maximum amount of vapor phase fluid in the cell will be that needed to saturate the air in the cell. Upon being treated with the treatment fluid 14 within the treatment cell 42, the work product 12 exits the treatment cell 42 through the second treatment cell aperture 62.

A blower 84 for directing air is located within the containment chamber 16 adjacent to the containment aperture 36 as shown. The blower 85 has an intake port 86 and an output port 88, both located entirely within the containment chamber 16. The blower 84 is powered by a blower motor 81 located external to the containment chamber 16. A point of invention includes the blower motor 81 being outside the containment chamber 16 and so out of contact with vapor laden air. A fluid-tight rotary seal of any usual or preferred structure is provided between the blower motor 81 and the blower 84, and forms no part of the invention per se.

The purpose of the blower 84 is to create an air force and to direct that air force towards the work product 12 to blow off any excess liquid phase or vapor phase treatment fluid 14 clinging to the work product 12 and to blow it away from the containment chamber apertures 34 and 36. This has the effect of minimizing the loss of vapor laden air from the containment chamber and the consequent infiltration of vapor free ambient air into the chamber.

The blower 84 accomplishes the above result by supplying air to a first and a second air knife 90 and 92, respectively, each of which directs air to all sides of the work product 12. The first air knife 90 and the second air knife 92 are connected by an air flow conduit 93 to the blower output port 88. As the work product 12 leaves the containment chamber 16, the first air knife 90 directs a sharp blade of air toward the work product 12 to assure that any excess treatment fluid 14 present on the work product 12, after it has left the treatment cell 42, does not leave the containment chamber 16. As the untreated work product 12 enters the containment chamber 16, the second air knife 92 directs a sharp blade of air toward the work product 12 to try to insure that no air laden with fluid vapor phase or splashing liquid phase of treatment fluid 14 escapes through the first containment chamber aperture seal 38.

After the first air knife 90 blows off any excess liquid phase treatment fluid 14, the treatment fluid 14 tends to be entrained in air if that air is not already saturated with it. In order to collect the treatment fluid 14 for reuse, a cooling means or mechanism 94 is provided for cooling the air laden with treatment fluid 14 after the fluid has been blown from the work product 12 and while it is in the vapor phase. This reduces the vapor pressure of the fluid and condenses some of it from the air. The cooling mechanism 94 is preferably located lower than the containment chamber apertures 34 and 36 within the containment chamber 16.

The cooling mechanism 94 includes a plurality of cold condensation coils 96. A refrigerant or other cooling vehicle such as cold cooling water can be circulated within coils 94. As the vapor phase of the treatment fluid 14 condenses to the liquid phase, it returns by gravity to the reservoir 74 where it can be recirculated.

The present invention greatly reduces the escape of air laden with treatment fluid into the atmosphere. Without the present invention, large amounts of treatment fluid 14 are being emitted into the atmosphere on a daily basis. By using the present invention, the vapor phase of the treatment fluid 14 can be economically condensed from the air in the containment chamber 16. The annual cost of treatment fluids to make up for that lost into the atmosphere can be reduced by up to 90%. In America, at this time, the reduction in the amount of escaped treatment fluid pollutants into the atmosphere can be on the order of millions of pounds per year.

Although the present invention has been described with reference to preferred embodiments, workers skilled in the art will recognize that changes may be made in form and detail without departing from the spirit and scope of the invention.

What is claimed is:

1. In an apparatus for applying a treatment fluid from a sealed reservoir to an elongate, continuously moving work product as it passes through a treatment cell, which treatment fluid has a characteristic of changing between a liquid phase and a vapor phase under the operating conditions of the apparatus, the improvement wherein:

(a) the treatment cell is completely encompassed by a fluid impervious containment chamber which is provided with an ingress aperture and an egress aperture;

(b) the treatment fluid is delivered from the sealed reservoir through a sealed conduit open to the interior of the cell in the chamber;

(c) the containment chamber ingress aperture is adapted to encompass the moving work product as it moves into the chamber in direction toward and through the treatment cell, and its egress aperture is adapted to encompass the moving work product as it moves out of the containment chamber;

(d) an air flow restriction seal is provided over the ingress aperture and over the egress aperture, each seal being provided with an opening of configuration to come into intimate relation to the moving work product to inhibit passage of air and fluid as the work product moves through the aperture associated with that seal;

(e) a blower means entirely within the containment chamber directs air from within the chamber and any vapor entrained with the air toward the moving work product between the ingress aperture and the treatment cell and between the egress aperture and the treatment cell in direction away from the apertures and toward the treatment cell with sufficient force to tend to strip all liquid phase of the treatment fluid from the moving work product;

(f) a cooling means within the chamber operates to lower the vapor pressure to tend to cause condensation of the vapor phase of the treatment fluid from the air; and (g) sealed recovery means is provided to convey the liquid phase of the treatment fluid from bottom portions of the containment chamber and the treatment cell back to the sealed reservoir.

2. In an apparatus for applying a treatment fluid from a sealed reservoir to an elongate, continuously moving work product as it passes through a treatment cell, which treatment fluid has a characteristic of changing between a liquid phase and a vapor phase under the operating conditions of the apparatus, the improvement wherein:

(a) the treatment cell is completely encompassed by a fluid impervious containment chamber which is provided with an ingress aperture and an egress aperture;

(b) the treatment fluid is delivered from the sealed reservoir through a sealed conduit open to the interior of the cell in the chamber;

(c) the containment chamber ingress aperture is adapted to encompass the moving work product as it moves into the chamber in direction toward and through the treatment cell, and its egress aperture is adapted to encompass the moving work product as it moves out of the containment chamber;

(d) an air flow restriction seal is provided over the ingress aperture and over the egress aperture, each seal being provided with an opening of configuration to come into intimate relation to the moving work product to inhibit passage of air and fluid as the work product moves through the aperture associated with that seal;

(e) a blower means entirely within the containment chamber directs air from within the chamber and any vapor entrained with that air toward the moving work product between the egress aperture and the treatment cell in direction away from the egress aperture and toward the treatment cell with sufficient force to tend to strip all liquid phase of the treatment fluid from the moving work product;

(f) a cooling means within the chamber operates to lower the vapor pressure to tend to cause condensation of the vapor phase of the treatment fluid from the air; and (g) sealed recovery means is provided to convey the liquid phase of the treatment fluid from bottom portions of the containment chamber and the treatment cell back to the sealed reservoir.

3. A treatment fluid application and recovery apparatus for treating an elongate, continuously moving work product with a treatment fluid from a sealed reservoir, which treatment fluid has a characteristic of changing between a liquid phase and a heavier-than-air vapor phase under the operating conditions of the apparatus the apparatus including:

a fluid impervious containment chamber provided with first and second containment chamber apertures for receiving and discharging the moving work product;

a fluid impervious treatment cell located entirely within the containment chamber, the treatment cell having first and second treatment cell apertures therethrough whereby the work product enters the treatment cell through the first treatment cell aperture and exits the treatment cell through the second treatment cell aperture;

an air flow restriction seal affixed over each of the first and second containment chamber apertures, each seal being provided with an opening of configuration to contact the moving work product to tend to inhibit passage of air and fluid through its aperture;

application means for applying the treatment fluid to the work product in the treatment cell;

sealed pumping means for delivering the treatment fluid from the sealed reservoir to the application means within the treatment cell;

blower means including a blower within the containment chamber whereby the blower means directs air and any vapor entrained with the air from within the containment chamber towards the work product in direction and with sufficient force to tend to blow any excess treatment fluid from the work product moving into and out of the containment chamber and to blow such fluid in direction away from the containment chamber apertures;

cooling means within the containment chamber operating to cool the air borne vapor phase of the treatment fluid in the containment chamber to tend to condense it from its vapor to its liquid phase; and sealed recovery means open to bottom portions of the containment chamber and treatment cell and open to the sealed reservoir for delivering the liquid phase of the treatment fluid back to the sealed reservoir.

4. The apparatus of claim 3 wherein the application means includes a spraying mechanism, the spraying mechanism being connected to the pumping means and directing the treatment fluid to all sides of the work products.

5. The apparatus of claim 3 wherein the blower means includes a plurality of air knives, each air knife being located within the containment chamber with at least one air knife being adjacent each of the chamber containment apertures.

6. The apparatus of claim 3 wherein the cooling means includes at least one cold condensation coil located lower than either containment chamber aperture.

7. The apparatus of claim 3 wherein the seals embody an elastomer.

8. A method of treating a continuously moving work product with a treatment fluid which has a characteristic of changing between a liquid phase and a vapor phase under the operating conditions of the apparatus, the method being such as to retain and recover a substantial quantity of the treatment fluid, the method including the steps of:

providing a fluid impervious containment chamber having first and second containment apertures for receiving and discharging the moving work product;

providing a fluid impervious treatment cell located entirely within the containment chamber, the treatment cell having first and second treatment cell apertures therethrough whereby the work product enters the treatment cell through the first treatment cell aperture and exits the treatment cell through the second treatment cell aperture;

applying the treatment fluid from a sealed reservoir to the moving work product in the treatment cell to only that portion of the moving work product which is within the treatment cell;

blowing any excess treatment fluid from the work product moving into and out of the containment chamber and away from the containment apertures; and draining all liquid phase of the treatment fluid from the chamber and the cell back into the sealed reservoir.

9. The method of claim 8 and further including the step of:

cooling the treatment fluid in the containment chamber to tend to condense it from the vapor to its liquid phase.

10. In an apparatus for applying a treatment fluid from a sealed reservoir to an elongate, continuously moving work product as it passes through a treatment area, which treatment fluid has a characteristic of changing between a liquid phase and a vapor phase under the operating conditions of the apparatus, the improvement wherein:

(a) the treatment area is completely encompassed by a fluid impervious containment chamber which is provided with an ingress aperture and an egress aperture;

(b) the treatment fluid is delivered from the sealed reservoir through a sealed conduit open to the treatment area within the chamber;

(c) the containment chamber ingress aperture is adapted to encompass the moving work product as it moves into the chamber in direction toward and through the treatment area, and its egress aperture is adapted to encompass the moving work product as it moves out of the containment chamber;

(d) an air flow restriction seal is provided over the ingress aperture and over the egress aperture, each seal being provided with an opening of configuration to come into intimate relation to the moving work product to inhibit passage of air and fluid as the work product moves through the aperture associated with that seal;

(e) a blower means entirely within the containment chamber directs air from within the chamber and any vapor entrained with that air toward the moving work product between the egress aperture and the treatment area in direction away from the egress aperture and toward the treatment area with sufficient force to tend to strip all liquid phase of the treatment fluid from the moving work product;

(f) a cooling means within the chamber operates to lower the vapor pressure to tend to cause condensation of the vapor phase of the treatment fluid from the air; and (g) sealed recovery means is provided to convey the liquid phase of the treatment fluid from bottom portions of the containment chamber back to the sealed reservoir.

11. In an apparatus for applying a treatment fluid from a sealed reservoir to an elongate, continuously moving work product as it passes through a treatment area, which treatment fluid has a characteristic of changing between a liquid phase and a vapor phase under the operating conditions of the apparatus, the improvement wherein:

(a) the treatment area is completely encompassed by a fluid impervious containment chamber which is provided with an ingress aperture and an egress aperture;

(b) the treatment fluid is delivered from the sealed reservoir through a sealed conduit open to the treatment area within the chamber;

(c) the containment chamber ingress aperture is adapted to encompass the moving work product as it moves into the chamber in direction toward and through the treatment area, and its egress aperture is adapted to encompass the moving work product as it moves out of the containment chamber;

(d) an air flow restriction seal is provided over the ingress aperture and over the egress aperture, each seal being provided with an opening of configuration to come into intimate relation to the moving work product to inhibit passage of air and fluid as the work product moves through the aperture associated with that seal;

(e) a blower means entirely within the containment chamber directs air from within the chamber and any vapor entrained with that air toward the moving work product between the ingress aperture and the treatment area and between the egress aperture and the treatment area in direction away from the apertures and toward the treatment area with sufficient force to tend to strip all liquid phase of the treatment fluid from the moving work product;

(f) a cooling means within the chamber operates to lower the vapor pressure to tend to cause condensation of the vapor phase of the treatment fluid from the air; and (g) sealed recovery means is provided to convey the liquid phase of the treatment fluid from bottom portions of the containment chamber back to the sealed reservoir.

* * * * *